US005273289A

United States Patent [19]

Morse

[11] Patent Number: 5,273,289

[45] Date of Patent: Dec. 28, 1993

[54] PICTURE PUZZLE ASSEMBLING PLATFORM

[76] Inventor: Frederick Morse, P.O. Box 638, Fiddler Reach Rd., Bath, Me. 04530

[21] Appl. No.: 923,623

[22] Filed: Aug. 3, 1992

[51] Int. Cl.[5] ..... A63F 9/00

[52] U.S. Cl. ..... 273/237; 273/148 R; 273/287; 273/309; 273/285

[58] Field of Search ..... 273/148 R, 309, 157 R, 273/272, 287, 285, 237

[56] References Cited

U.S. PATENT DOCUMENTS

| | | | |
|---|---|---|---|
| 415,371 | 11/1889 | Smith | 273/287 |
| 2,506,189 | 5/1950 | Attridge | 273/157 R |
| 2,729,451 | 1/1956 | Larson | 273/285 |
| 3,741,548 | 6/1973 | Kaupp | 273/157 R |
| 4,384,722 | 5/1983 | Higgins | 273/272 |
| 4,790,540 | 12/1988 | Lim et al. | 273/309 |
| 5,120,069 | 6/1992 | Shaw | 273/309 |

FOREIGN PATENT DOCUMENTS

| | | | |
|---|---|---|---|
| 1175447 | 12/1969 | United Kingdom | 273/157 R |

*Primary Examiner*—Benjamin H. Layno
*Attorney, Agent, or Firm*—Frederick R. Cantor

[57] ABSTRACT

A picture puzzle assembling platform, that includes at least two inclined panels, symmetrically arranged around a central axis, such that a person can sit facing each panel to assemble a puzzle, from pieces placed on a table surface in front of the panel. Preferably, each person assembles a different puzzle on one of the inclined panels. The inclination of each panel, enables the person facing the panel, to have a direct view of the partially assembled picture puzzle, so that the person can move more quickly to locate the correct puzzle piece for each puzzle space. The panel inclination thus facilitates the puzzle assembling process, and adds to the person's interest in completing the assembly of the picture puzzle. Each inclined panel, forms a support surface for a different puzzle, so that persons sitting in front of the inclined panels, may engage in a contest, with each person trying to complete his/her puzzle before the other person completes theirs.

3 Claims, 4 Drawing Sheets

PICTURE PUZZLE ASSEMBLING PLATFORM

BACKGROUND OF THE PRESENT INVENTION

The present invention, relates to a table-like platform, that can be used for assembling picture puzzle pieces into a completed picture. The platform, also having a plurality of inclined panels, serves as an alternative to a conventional table that is commonly used for supporting the pieces of a puzzle, while they are being fitted together to form a completed picture.

Picture puzzles commonly comprise five hundred, or more, separate pieces, having mating side edges, such that when the individual pieces are placed alongside each other in the proper order, the pieces fit together to form a picture. Quite often, the puzzle pieces have mating convex and concave sections, that interlock, to hold adjacent pieces together, while the picture puzzle is being assembled.

Conventionally, such picture puzzles are assembled into a complete picture by placing the individual pieces on a flat horizontal table surface, and fitting them together on a trial-and-error basis. When the picture puzzle contains a considerable number of pieces, a relatively large size table is required to contain all of the individual pieces. The person, or persons, assembling the picture puzzle pieces together, often have difficulty in clearly seeing all of the pieces, because the person's line of sight is acutely angled to the plane of the table, especially along the table rear edge, located away from the person's head. When a puzzle piece is viewed at an acute angle, i.e., along a sight line that is oblique to the plane of the puzzle piece, the shape of the puzzle piece appears slightly distorted, such that the person may not readily recognize that a particular puzzle piece fits into a given puzzle space. Often the person will search for several minutes to find a puzzle piece that can fit into a particular space, and then give up the search. If this situation is repeated a number of times, the person may lose interest in completing the puzzle.

The present invention is concerned with a platform that can be used to support the pieces of a puzzle, such that the individual pieces are more easily seen, whereby the person has a greater capability of selecting the correct puzzle piece to fit into any given puzzle space. A major aim of the present invention, is to enable the person to more readily facilitate fitting the various puzzle pieces together, without the endless searching that is often required with conventional arrangements.

The picture puzzle assembling platform would be exceedingly helpful for a bed-ridden person, an example would be having the portable puzzle-assembling platform clamped to a hospital bedside table, or a regular table, that would swing over the bed of the ill person. Further, it may be utilized for a handicapped person in a wheel chair, using the larger pedestal-type picture puzzle assembling platform, which would be built high enough for the wheel chair to move in as close as possible, as needed. Also, the present invention may be used for a person with arthritic conditions, as the puzzle would be closer, and the person would not have to reach into the far rectangular corners, as with a regular puzzle.

SUMMARY OF THE PRESENT INVENTION

The present invention contemplates a picture puzzle assembling platform, that comprises, at least two flat puzzle support panels of similar size and shape. Each puzzle support panel, has a front edge, two side edges, and a rear edge. The individual puzzle support panels are inclined in a front-to-rear direction, with said support panels being arranged symmetrically around a central axis, located near the panel rear edges. Pieces of the puzzle are placed on each inclined panel so that a person sitting in front of the respective panel can look down onto the panel to view the individual puzzle pieces.

Due to the inclined nature of each support panel, the puzzle pieces are viewed along sight lines that are essentially normal to the puzzle piece plane. The shape of each puzzle piece is, therefore, more accurately seen and visualized, by the person attempting to fit, or assemble, the puzzle pieces together. Consequently, the person assembling the puzzle pieces, has an enhanced opportunity to more readily fit, all of the puzzle pieces together. This makes the puzzle assembling process more interesting, as the person is not as likely to prematurely give up the effort, because of a failure to find a proper piece to fit into a given space, within a reasonable time period.

If a picture puzzle were to contain five hundred pieces, and a person were to require an average time of two minutes to assemble each puzzle piece into the completed picture, the total assembly time would be approximately one thousand minutes, which equates to almost seventeen hours. It is believed that the average person will not sustain his/her interest in the puzzle assembly for a seventeen hour period.

The present invention seeks to enhance the ability of the person to clearly see the true shape of each puzzle piece, so that the person can more readily pick the correct puzzle piece for fitting into each particular space in the picture puzzle. An objective is, therefore, to limit the total time required to assemble all of the puzzle pieces together, to a reasonable time, whereby the person maintains a continuing interest in completing the puzzle, rather than giving up the effort before the picture puzzle assembly is completed. This is particularly true for handicapped users, as well as bed-ridden children.

The apparatus of the present invention, preferably comprises four inclined puzzle piece support panels, arranged around a central axis, in a pyramid configuration. The preferred embodiment, allows up to four persons to sit facing each of the four panels, with each person being required to assemble a picture puzzle on his/her respective support panel. This arrangement, introduces a competition factor into the picture puzzle assembling process, in that the four persons are enabled to compete against each other, in order to see who can complete his/her puzzle in the shortest period of time.

The four puzzles, will preferably have approximately the same number of pieces, in order to make the contest as fair as possible. Also, the four puzzles may be exact duplicates of one another, i.e., with the same picture, or scene, and with the same configurations of the individual puzzle pieces.

Additionally, it is envisioned that, panorama-type picture puzzles, could be manufactured and placed in a specific arrangement, whereby, all four sides of the table, or fewer sides, if desired, could be used to assemble a multi-sided panoramic picture.

The present invention, may be used on a hospital side table, if clamped on properly, and with a turntable base added, so that the patient might turn the puzzle assembling platform, as desired. Also, as mentioned previously, it can be used by a handicapped person in a wheel chair, if a high pedestal table support is used.

Although, the preferred apparatus includes four inclined support panels, for supporting four different puzzles, it is not necessary that all four panels be used in every instance. The competitive aspect of the picture-completing activity can be also engaged in by two or three people. Four contestants, represents the maximum number with a pyramid type platform.

Each panel in the pyramid-shaped platform preferably has an inclination angle of at least about thirty (30) degrees, in order to provide enhanced visibility of the individual puzzle pieces. The inclination angle of each support panel can be greater, e.g., up to about forty-five (45) degrees. However, if the inclination angle were increased to an excessive extent, then the pieces of the puzzle would tend to slide downwardly on the panel surface, due to gravitational force. This would be a potential annoyance which would detract from the enjoyment of the game. The preferred inclination angle of each puzzle support panel is no more than about forty-five (45) degrees. A ledge extends along the front edge of each panel, in order to prevent the lower edge pieces of the puzzle from falling off the panel surface. The ledge also acts as a reference device to maintain the puzzle edge linear.

In summary, and in accordance with the above discussion, the foregoing objectives are achieved in the following embodiments.

1. A picture puzzle assembling platform, comprising, at least two flat puzzle support panels, of similar size and shape; each support panel having a front edge, two side edges, and a rear edge; each support panel, being inclined in a front-to-rear direction; said support panels being symmetrically arranged around a central axis, so that their rear edges are in near proximity to said central axis, and their front edges are spaced away from said central axis, whereby each support panel can be used by a different person sitting in a position facing the respective panel; each support panel, having an upstanding ledge means, extending along its front edge, for engagement with an edge of a puzzle, to prevent displacement of the puzzle off the panel surface.

2. The puzzle assembling platform, as described in paragraph 1, wherein each support panel, has an inclination angle of approximately forty-five (45) degrees.

3. The puzzle assembling platform, as described in paragraph 1, wherein each ledge means, has a lip extending therealong the panel surface, whereby puzzle pieces can be placed on the panel surface, with edge areas thereof, extending underneath said lip.

4. The puzzle assembling platform, as described in paragraph 1, wherein there are four puzzle support panels; each panel having a trapezoidal shape, with said front and rear edges thereof, being parallel to each other; said panels being arranged around said central axis, so that said side edges of adjacent panels, are contiguous.

5. The puzzle assembling platform, as described in paragraph 4, and further comprising, a hollow upstanding post, located on the aforementioned central axis, an electric light supported on said post, and a shade overlying said light, for directing light rays angularly downwardly along the upper surfaces of said panels.

6. The puzzle assembling platform, as described in paragraph 4, wherein said four puzzle support panels, have contiguous side edges thereof hingedly connected together, whereby said four support panels, can be folded onto one another, to form a package, having the outline configuration of a single panel.

7. The puzzle assembling platform, as described in paragraph 4, and further comprising, a puzzle-confining strip, extending along each side edge of each support panel.

8. The puzzle assembling platform, as described in paragraph 1, wherein each support panel has a friction-type upper surface, whereby puzzle pieces placed on said panel upper surface, are deterred from slipping downwardly therealong, due to gravitational force.

9. The puzzle assembling platform, as described in paragraph 1, and further comprising, upstanding ledges, extending along said front edge and said side edges of each support panel, whereby puzzle pieces placed on the support panel surfaces, are prevented from escaping from said panel surfaces.

DESCRIPTION OF THE PREFERRED EMBODIMENTS OF THE PRESENT INVENTION

Figure 1:
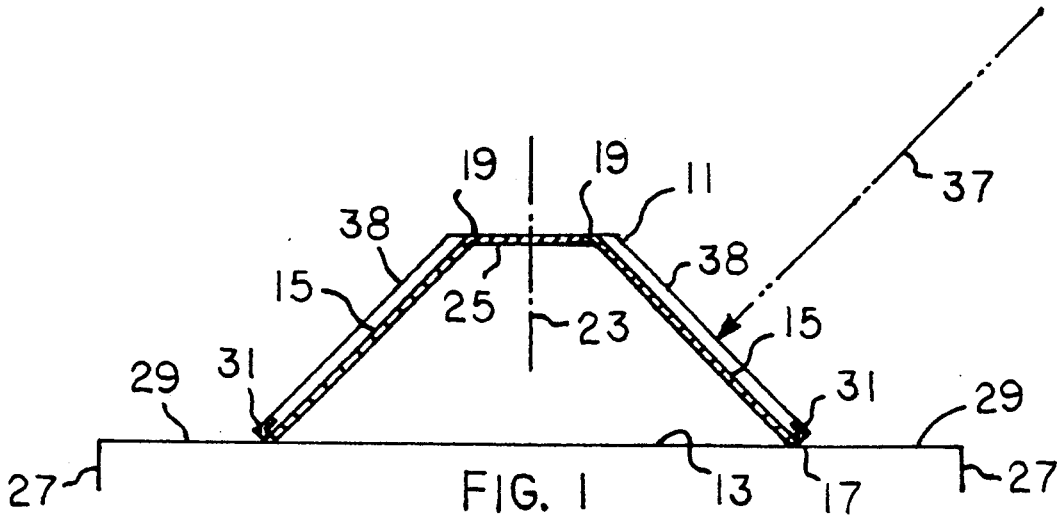
FIG. 1, is a sectional view, taken through a pyramid-type platform, embodying features of the present invention.

FIG. 1, is a sectional view, taken through a pyramid-type platform, embodying features of the present invention.

Figure 2:
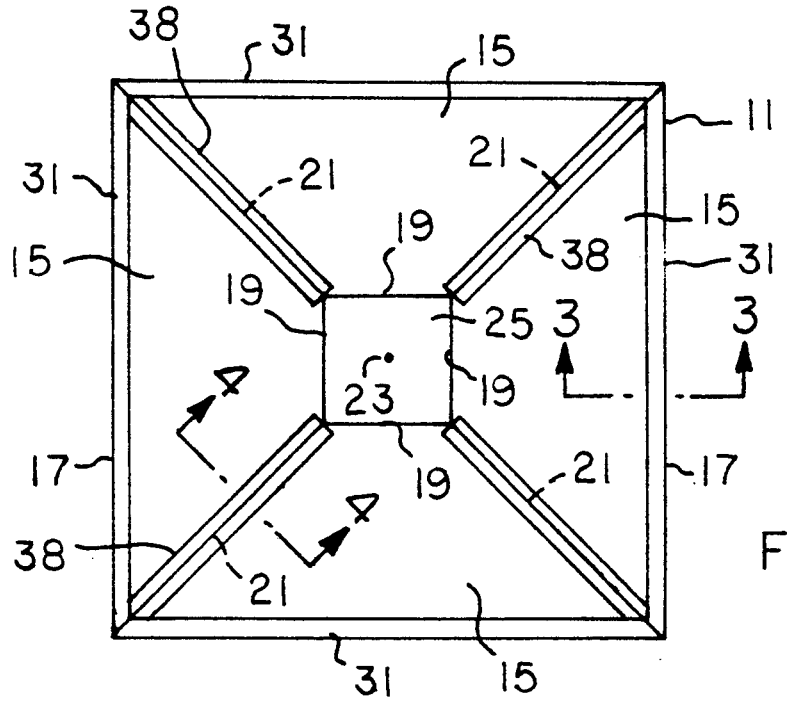
FIG. 2, is a top plan view, of the FIG. 1 pyramid-type platform.

FIG. 2, is a top plan view, of the FIG. 1 pyramid-type platform.

Figure 3:
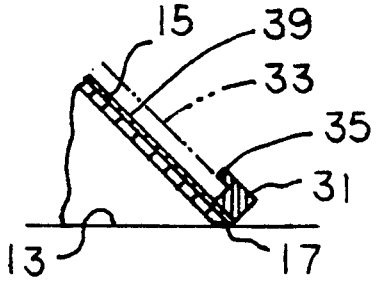
FIG. 3, is a fragmentary, enlarged, sectional view, taken along line 3—3, in FIG. 2.

FIG. 3, is a fragmentary, enlarged, sectional view, taken along line 3—3, in FIG. 2.

Figure 4:
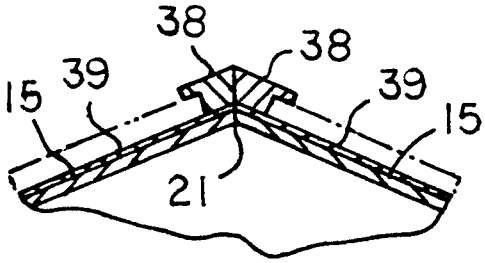
FIG. 4, is a fragmentary, enlarged, sectional view, taken along line 4—4, FIG. 2.

FIG. 4, is a fragmentary, enlarged, sectional view, taken along line 4—4, FIG. 2.

Referring now to FIGS. 1 through 4, there is shown a picture puzzle assembling platform 11, resting on a conventional table top surface 13. The platform 11, can be readily removable from the supporting table for storage, such that the table can be used for its normal purpose when the platform is so removed.

Platform 11, comprises four flat puzzle support panels 15, with each panel 15, having a trapezoidal configuration, defined by a front edge 17, a rear edge 19, and two side edges 21. Each support panel 15, front edge 17, is parallel to each associated support panel 15, rear edge 19.

The four support panels 15, are similarly sized, and similarly inclined, in a front-to-rear direction, such that the rear edge 19, of each panel 15, is elevated above the associated front panel edge. The panels 15, are symmetrically arranged, around a central axis 23, so that their rear edges 19, are in close proximity to axis 23, and their front edges 17, are spaced away from said central axis 23. Side edges 21, of the four panels 15, are contiguous to each other, and glued, or otherwise attached together, to give the platform 11, a four-sided pyramidal configuration. A square horizontal plate 25, has its edges glued or otherwise secured, to the rear edges 19, of the inclined panels 15, to rigidify, and reinforce, the panels.

The various panels 15, can be formed of any suitable construction material, e.g., fiberboard, wood, plastic, sheet metal, or the like. Additionally, the pyramidal configuration, can be formed by a casting, or molding, process.

In use of the pyramid-shaped platform 11, it is placed at a central point on a table surface 13, such that the front edge 17, of each panel 15, is spaced from the table edge 27, leaving table surfaces 29, exposed for placement of individual puzzle pieces thereon. The puzzles are assembled, or erected, on the four support panels 15, with the lower edge of each puzzle extending along a horizontal ledge means 31, secured to the front edge 17, of an associated panel 15.

In FIG. 3, the upper face areas of assembled puzzle pieces, are designated by numeral 33. The puzzle piece thickness is such that the front edge pieces of the puzzle can readily fit underneath a rearwardly protruding lip 35, formed on the associated ledge means 31. Lip 35, is an optional feature, that can be used to ensure a stable positioning of the puzzle front edge pieces, on each panel 15. Each person will preferably assemble his/her puzzle, from the front edge of the puzzle, proceeding rearwardly and upwardly.

With the illustrated apparatus, up to four persons can sit around table surface 13, each facing one of the four inclined support panels 15. Each person, will be supplied with a complement of picture puzzle pieces, necessary to complete one picture puzzle. Each person will use his/her individual panel 15, and associated table space 29, such that the four persons, work independently, and simultaneously, to complete their respective puzzles. The four persons, can thus be considered as contestants in a game, wherein the winner is the first person to complete his/her puzzle. The picture puzzle pieces will, ordinarily, be of the interlocking type, whereby the interlocked puzzle pieces will normally assume fixed positions on the panel surface without sliding or moving.

The inclination of each support panel 15, is advantageous, in that, the person is enabled to look essentially directly downwardly on the panel 15, to visually ascertain the shape of each puzzle space. The person can thus have a clearer, more informed idea of the puzzle shape needed to fit any given space in the partially assembled puzzle.

In FIG. 1, dashed line 37, represents a line-of-sight from a person's eye to a panel 15 surface. It will be seen that the line 37, extends approximately normal to the plane of panel 15, such that the person has an approximately direct view of the puzzle spaces on panel 15. This is particularly important with respect to the puzzle spaces near the panel rear edge 19.

In conventional puzzle arrangements, on a flat horizontal table surface, the person's line-of-sight is at acute angles to the puzzle plane, especially in areas near the puzzle upper (rear) edge that are relatively far away from the person's head. By inclining the puzzle-support surfaces, in a front-to-rear direction, it is possible to give the player a more accurate view of the puzzle space shapes and sizes. The un-assembled puzzle pieces resting on the table surface 29, as shown in FIG. 1, are normally easily viewed, because they are relatively close to the person's head. The person seated in front of the table, can readily look, essentially, directly down on the un-assembled pieces to see which ones might fit into a given space in the partially assembled puzzle on panel 15. Normally, the person will shift his/her gaze back and forth, between the panel 15, and the table surface 29, during the process of attempting to find a particular puzzle piece for a particular puzzle space. The inclination of each panel 15, greatly facilitates the 'hunting' process.

As shown in FIG. 1, each panel 15, is inclined in a front-to-rear direction at an inclination angle of approximately forty-five (45) degrees. This represents an optimum angle, in respect to viewability of the assembled puzzle pieces. The assembled pieces are normally securely interlocked together, so as to maintain a given position on the panel 15, in spite of gravitational forces, tending to cause downward sliding of loose puzzle pieces on the panel 15, surface.

However, should loose pieces be placed on the panel 15 surface, they could, possibly, slide downwardly, if the panel 15 surface, had a sufficiently low coefficient of friction. In order to prevent such sliding action, the upper surface of each panel 15, can be coated with a thin film 39, of friction material, such as rubber, roughened plastic, woven cloth, or the like. If the inclination angle of each panel 15, is sufficiently low, e.g., thirty (30) degrees, or less, then the friction coating 39, may not be necessary, depending on the friction characteristics of the panel 15, material.

The primary purpose of the inclined panels 15, is to ensure an improved view of the partially assembled puzzle, whereby the person is enabled to more quickly and readily find the puzzle pieces needed to complete the puzzle. However, the inclined panels 15, also are advantageous, in that they effectively increase the total surface area of the table, such that the puzzle pieces, can be more easily separated and spaced apart for viewing purposes. Also, the four inclined panels 15, form four separated zones, controlled by the four players. It is readily seen that the puzzle pieces in one puzzle are not apt to be inadvertently mixed with the puzzle pieces of another puzzle. Each person, therefore, can easily keep track of the pieces in his/her puzzle.

In order to further separate one puzzle from another puzzle, a puzzle confining strip 38, may be provided along each side edge of each panel 15. The confining strips 38, prevent pieces of a given puzzle from sliding laterally off of the associated panel 15, so as to possibly become mixed with another person's puzzle. To eliminate confusions, resulting from the mixing of pieces of different picture puzzles, the 'backs' of the puzzle pieces from different puzzles, could be readily identified by the use of a different color. Additionally, as an optional feature, each confining strip 38, can have a lip thereon, similar to the aforementioned lip 35, on ledge means 31.

If the entire area of each panel 15, is to be used to support a picture puzzle, the complete picture puzzle will have a trapezoidal shape, so as to substantially fill the panel 15, surface. However, the puzzle can have any desired shape, e.g., square, rectangular, hexagonal, etc. The pyramidal-shaped platform 11, provides spaces for four separate puzzles. However, in any given instance, only two or three of the four panels 15, need be used, while still obtaining the advantages of the present invention.

The construction of the embodiment shown in FIGS. 1 through 4, is a unitary one piece structure, having a definite three-dimensional shape. FIGS. 5 through 8, illustrate another form of the present invention that, can be folded, or otherwise disassembled, to assume a flat compact configuration, highly suitable for point-of-sale packaging, or home storage. By making the structure foldable, it is possible to reduce manufacturing costs, shipping costs and inventory storage costs. However, the flat compact configurations, following disassembly, may not be possible in some embodiments, e.g., those which are equipped with lighting, and internal electrical conductors.

Figure 5:
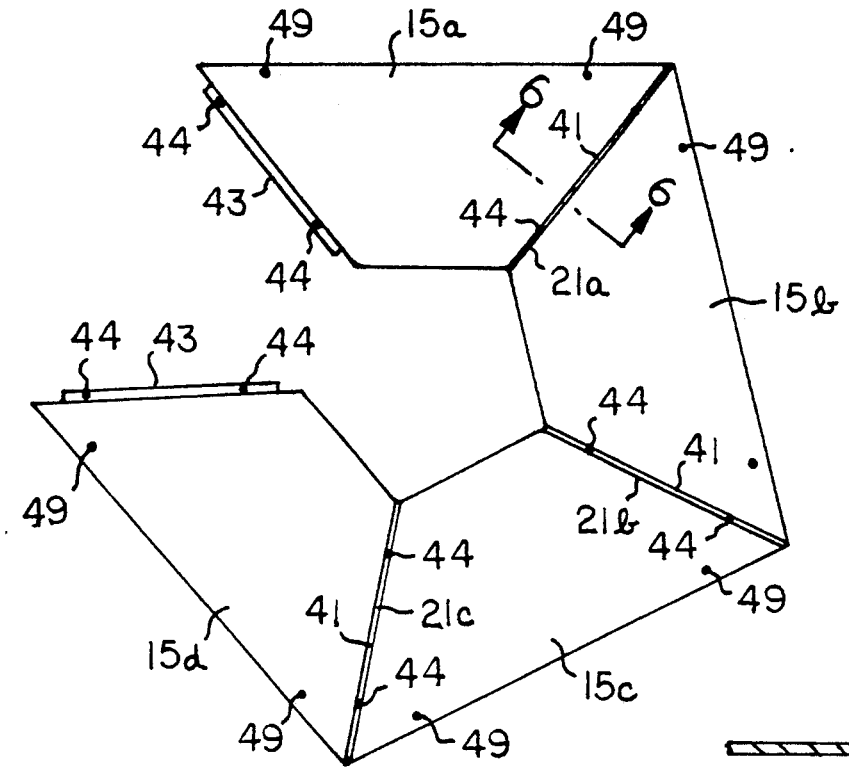
FIG. 5, is a plane view, of another apparatus constructed according to the present invention. The apparatus is shown in a collapsed condition.

FIG. 5, is a plane view, of another apparatus constructed according to the present invention. The apparatus is shown in a collapsed condition.

Figure 6:
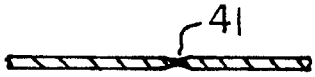
FIG. 6, is a fragmentary, sectional view, taken along line 6—6, in FIG. 5.

FIG. 6, is a fragmentary, sectional view, taken along line 6—6, in FIG. 5.

The structure shown in FIG. 5, comprises four panels, 15*a*, 15*b*, 15*c*, and 15*d*, having contiguous side edges 21*a*, 21*b*, and 21*c*, hingedly connected together, as at 41. As shown in FIG. 6, the hinged connection can be formed by scoring the panel material with a suitable sharp-edged presser element. The presser element, can be heated to achieve a localized heating of the panel material, for thinning the material to form a hinged connection. With heavier panel constructions, the hinges can be piano hinges, or the like, extending along the panel side edges.

When the various panels, i.e., 15*a*, 15*b*, 15*c*, and 15*d*, are hingedly joined together, they can be folded onto one another, in order to form a relatively flat package, having a relatively small outline dimension, optimally the outline of a single panel.

The free side edges of panels 15*a* and 15*d*, may be provided with relatively thin tabs 43. When the foldable panel is bent at the hinge lines into a pyramidal shape, the tabs 43, will overlap. Pin type fasteners, can then be extended through the holes 44, in tabs 43, to secure panels 15*a* and 15*d* together, thereby maintaining the structure in its pyramidal shape.

Additionally, other hinging, and/or edging, configurations are envisioned, to allow for convenient stacking, or layering, of the unfolded, or 'opened', embodiments of the present invention.

Figure 8:
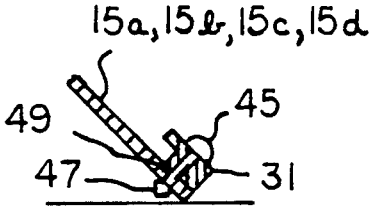
FIG. 8, is a fragmentary, sectional view, taken through a front edge of the FIG. 5 apparatus, and showing a ledge structure removably attached thereto.

FIG. 8, is a fragmentary, sectional view, taken through a front edge of the FIG. 5 apparatus, and showing a ledge structure removably attached thereto.

FIG. 8, illustrates a mechanism for removably attaching a ledge element 31, to a lower edge of any one of the four panels 15*a*, 15*b*, 15*c*, or 15*d*. Pin type fasteners 45, preferably formed of a soft deformable plastic material, and having enlarged ends 47, may be forced through aligned holes 49, in the ledge element 31, and panel material, to releasably attach the ledge element 31, to the panel.

Figure 7:
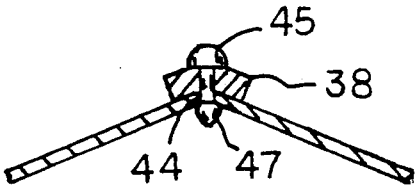
FIG. 7, is a fragmentary, sectional view, taken in the same direction as FIG. 6, but with the apparatus bent into a pyramid configuration, and with a puzzle-confining strip, attached to a side edge of the pyramid.

FIG. 7, is a fragmentary, sectional view, taken in the same direction as FIG. 6, but with the apparatus bent into a pyramid configuration, and with a puzzle-confining strip, attached to a side edge of the pyramid.

FIG. 7, illustrates a generally similar pin-type fastener means 45, for fastening separator strips 38, to the side edges areas of panels 15*a*, 15*b*, 15*c*, and 15*d*. Each pin-type fastener 45, will pass through aligned holes 44, in the respective separator strip 38, and associated panel. The same system may be used to attach a separator strip 38, to the overlapped tabs 43, see FIG. 5; the fastener pins 45, will then extend through holes 44, in the tabs 43. It should also be noted, that equivalent fastening means are envisioned, which would not need to be exposed.

When the platform device of FIGS. 5 through 8, is formed into its three-dimensional pyramidal configuration, it performs in essentially the same fashion as the embodiment, of FIGS. 1 through 4.

Figure 9:
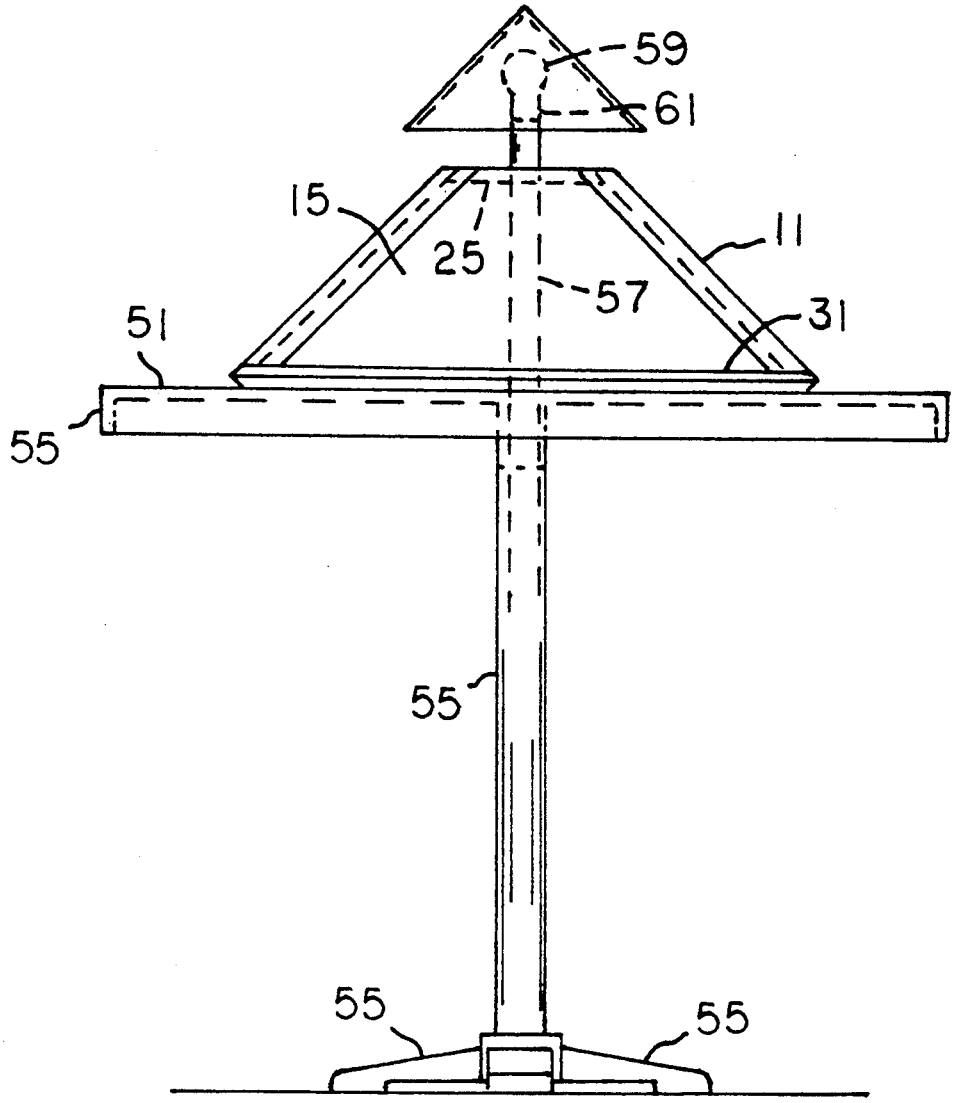
FIG. 9, is a side elevational view, of a pyramid apparatus of the present invention, constructed as a built-in addition to a conventional pedestal-type table.

FIG. 9, is a side elevational view, of a pyramid apparatus of the present invention, constructed as a built-in addition to a conventional pedestal-type table.

FIG. 9, illustrates yet another embodiment of the present invention, wherein the pyramidal-shaped platform 11, is built into a generally conventional table. As shown, the table comprises a square table top 51, having a peripheral skirt 53. A hollow, or tubular, pedestal 55, extends downwardly from top 51, to connect with four radial feet 55A.

A hollow post 57, has its lower end telescoped into pedestal 55, to form a continuous conduit for an electrical conductor, that supplies current to an electrical light 59, having a conventional screw-on connection with a light socket 61. The electrical conductor will extend within post 57, and pedestal 55, thence along the floor to a wall outlet, such that light 59, can be energized to illuminate the various panels 15. Post 57, will be located on the aforementioned central axis 23, such that each panel 15, receives the same illumination.

A lamp shade 63, overlies electric light 59, in order to diffuse, and direct light rays downwardly, along the surfaces of the four panels 15. Preferably, shade 63, comprises four flat, triangular panels, arranged in a pyramid configuration, whereby the diffused light rays are directed generally along, and above, the panel 15 surface, to minimize glare. The light illuminates the puzzle pieces placed on panels 15, and facilitates the puzzle assembling process. However, it should be noted that the lamp shade could be shaped other than in a triangular shape. Additionally, other embodiments are envisioned having a different lighting arrangement, e.g., wherein the electric light 59, may be supported by the internal structure of the table top 51, or the pedestal 55. Also, it is envisioned, that other means, i.e., non-telescoping, may be utilized to support, and/or illuminate, the puzzle assembling platform, of the present invention.

Further, when a lamp and/or a lamp shade, is not to be incorporated, a pyramidal-shaped 'peak' may be inserted in its place, over axis 23.

Figure 10:
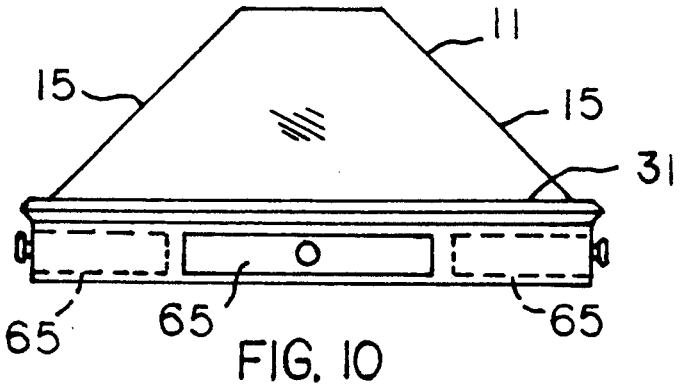
FIG. 10, is an elevational view, of an apparatus of the present invention, having a drawer mounted beneath each inclined panel, for containment of puzzle pieces.

FIG. 10, is an elevational view, of an apparatus of the present invention, having a drawer mounted beneath each inclined panel, for containment of puzzle pieces.

FIG. 10, shows yet another embodiment of the present invention, that is generally similar to the construction of FIGS. 1 through 4, except that four drawers 65, are slidably mounted in a square cabinet, that forms a base for the pyramidal-shaped platform 11. The four drawers 65, can be used to store the pieces of the puzzles that are to be assembled on the various inclined panels 15. As shown in FIG. 10, there are no puzzle retention strips, similar to strips 38, shown in FIGS. 1, 2, and 4. Such retention strips 38, may be employed, and are considered an optional feature of the present invention, to be utilized where it is felt that the puzzle pieces may be inadvertently 'knocked', or 'blown', off the panels 15.

The various structural embodiments depicted in FIGS. 1 through 10, are suitable for use by persons in a competitive game involving the assembling of four different puzzles.

Figure 11:
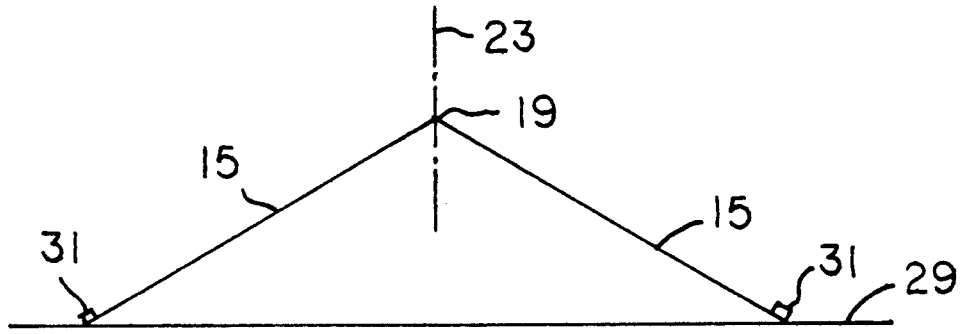
FIG. 11, is a side elevational view, of another embodiment of the present invention, having two inclined panels arranged in a back-to-back relationship.

FIG. 11, is a side elevational view, of another embodiment of the present invention, having two inclined panels arranged in a back-to-back relationship.

Figure 12:
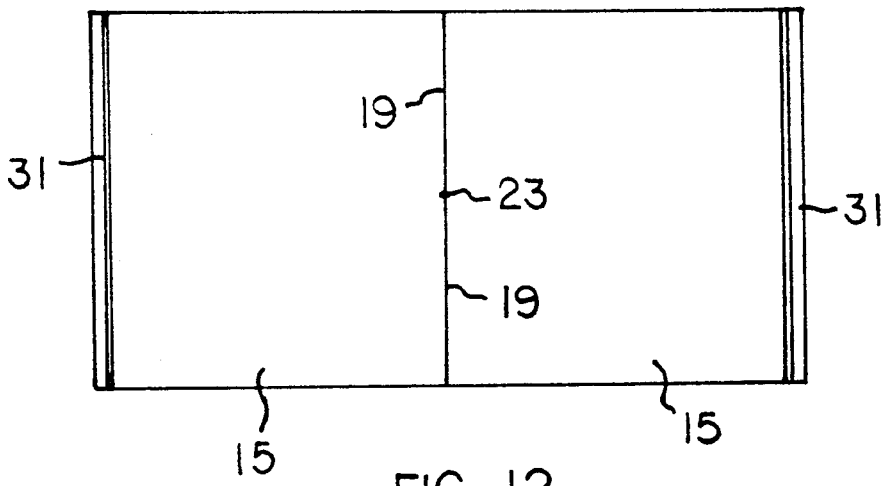
FIG. 12, is a top plan view, of the embodiment shown in FIG. 11.

FIG. 12, is a top plan view, of the embodiment shown in FIG. 11.

FIGS. 11 and 12, show another variant of the present invention, suitable for use by only two persons. Each person would sit facing an inclined panel 15, such that they can competitively assemble individual picture puzzles, in the previously described fashion.

Each panel 15, has a rectangular configuration as viewed in FIG. 12. The panels 15, are arranged symmetrically, relative to a central axis 23, with the panel rear edges 19, being located at, or near, said central axis 23. Each panel 15, has an upstanding ledge means 31, extending along its front edge. The operation of the FIG. 11, construction is similar to that of the FIG. 1, construction except that it is limited to use by only two players, i.e., contestants.

The drawings show specific forms, or embodiments, that the present invention can take. However, it will be appreciated that the present invention can be practiced in various equivalent forms and configurations.

The present invention relates to a pyramidally-shaped puzzle assembling platform. Features of the present invention are recited in the appended claims. The drawings contained herein, necessarily depict specific embodiments of the apparatus, useful in practice of the present invention.

However, it will also be appreciated by those skilled in the arts pertaining thereto, that the present invention can be practiced in various forms and configurations. Further, the previous detailed descriptions of the preferred embodiments of the present invention, are presented for the purposes of clarity of understanding only, and no unnecessary limitations, should be understood or implied therefrom.

Finally, all appropriate mechanical and functional equivalents to the above, which may also be obvious to those skilled in the arts pertaining thereto, are considered to be encompassed within the claims of the present invention.

What is claimed is:

1. A picture puzzle assembling platform, comprising:
four flat puzzle support panels of similar size and shape;
each panel having a trapezoidal shape;
each panel having a front edge, two side edges, and a rear edge;
the front and rear edges of each panel being parallel to each other, and the two side edges of each panel being convergent from the front edge to the rear edge;
each panel being inclined upwardly in a front-to-rear direction;
said trapezoidal panels being symmetrically arranged around a central vertical axis, so that their respective rear edges are in near proximity to said central axis, and their front edges are spaced away from said central axis;
said trapezoidal panels being arranged so that their side edges are contiguous, whereby the puzzle assembling platform has a three-dimensional pyramid configuration;
an upstanding ledge extending along the front edge of each panel for engagement with an assembled puzzle to prevent gravitational displacement of the puzzle pieces off the panel surface;
a hollow upstanding post, extending upwardly through said platform on said central vertical axis;
an electric light supported on said post above said platform;
a hollow shade overlying said light; and
said shade having internal surfaces sloping downwardly away from the central vertical axis for directing light rays angularly downwardly along the upper surface of said panels.

2. A picture puzzle assembling platform, comprising:
four flat puzzle support panels of similar size and shape;
each panel having a trapezoidal shape;
each panel having a front edge, two side edges, and a rear edge;
the front and rear edges of each panel being parallel to each other, and the two side edges of each panel being convergent from the front edge to the rear edge;
each panel being inclined upwardly in a front-to-rear direction;
said trapezoidal panels being symmetrically arranged around a central vertical axis so that their respective rear edges are in near proximity to said central axis, and their front edges are spaced away from said central axis;
said trapezoidal panels being arranged so that their side edges are contiguous, whereby the puzzle assembling platform has a three-dimensional pyramid configuration;
a removable ledge means extending along the front edge of each panel for engagement with an assembled puzzle, to prevent gravitational displacement of the puzzle pieces off the panel surface; and
hinge means connecting contiguous side edges of the panels, whereby the panels can be folded onto one another to form a package having the outline configuration of a single panel.

3. A picture puzzle assembling platform, comprising:
four flat puzzle support panels of similar size and shape;
each support panel having a trapezoidal shape;
each panel having a front edge, two side edges, and a rear edge;
the front and rear edges of each panel being parallel to each other, and the two side edges of each panel being convergent from the front edge to the rear edge;

each panel being inclined upwardly in a front to rear direction;

said trapezoidal panels being symmetrically arranged around a central vertical axis so that their respective rear edges are in near proximity to said central axis, and their front edges are spaced away from said central axis;

said trapezoidal panels being arranged so that their side edges are contiguous, whereby the puzzle assembling platform has a three-dimensional pyramid configuration;

an upstanding ledge extending along the front edge of each panel for engagement with an assembled puzzle to prevent gravitational displacement of the puzzle pieces off the panel surface;

a puzzle confining strip means extending along the contiguous side edges of said panels; and each puzzle confining strip means comprising strip sections seated on the surfaces of two contiguous panels.

* * * * *